US005386081A

United States Patent [19]

Nakada et al.

[11] Patent Number: 5,386,081

[45] Date of Patent: Jan. 31, 1995

[54] AUTOMATIC PERFORMANCE DEVICE CAPABLE OF SUCCESSIVE PERFORMANCE OF PLURAL MUSIC PIECES

[75] Inventors: Takuya Nakada; Hiroyuki Iwase; Hiromu Miyamoto, all of Hamamatsu, Japan

[73] Assignee: Yamaha Corporation, Hamamatsu, Japan

[21] Appl. No.: 4,518

[22] Filed: Jan. 14, 1993

[30] Foreign Application Priority Data

Jan. 16, 1992 [JP] Japan ..... 4-025720

[51] Int. Cl.[6] ..... G10H 1/00

[52] U.S. Cl. ..... 84/609

[58] Field of Search ..... 84/609-614, 84/634-638

[56] References Cited

U.S. PATENT DOCUMENTS 4,889,026 12/1989 Abe ..... 84/611

5,239,124 8/1993 Eitaki et al. ..... 84/634

FOREIGN PATENT DOCUMENTS 63-298292 12/1988 Japan .

*Primary Examiner*—Stanley J. Witkowski

*Attorney, Agent, or Firm*—Spensley Horn Jubas & Lubitz

[57] ABSTRACT

Automatic performance data for plural music pieces is stored in a memory. An order setting circuit for setting the order of automatically performing these music pieces is provided. The automatic performance data is read out in accordance with the order of performance set by the order setting circuit, whereby the plural music pieces are successively performed. By operating an instruction switch during performance of a certain music piece, a control is made in response to this instruction to stop the performance of the music piece which is being played and shift to performance of a next music piece in accordance with the set order of performance. The music which is being played may be stopped at a position at which the pattern, measure or other predetermined performance section ends. The order of performance may be previously determined or may be set at random.

14 Claims, 5 Drawing Sheets

AUTOMATIC PERFORMANCE DEVICE CAPABLE OF SUCCESSIVE PERFORMANCE OF PLURAL MUSIC PIECES

BACKGROUND OF THE INVENTION

This invention relates to an automatic performance device used in an electronic musical instrument or the like and more particularly, to an automatic performance device for automatically performing prestored plural music pieces successively and which is capable of stopping, when desired, performance of a certain music piece which is being played at a suitable position and shifting to performance of a next music piece.

In conventional automatic performance device, performance data of plural music pieces are stored in a memory in advance and a desired one of the music pieces is selectively designated to provide an automatic performance thereof. When a user wishes to change a music piece to be played, he must make a selection operation for designating a new desired music piece and this involves a troublesome operation.

It has therefore been proposed to preset an order of automatically performing plural music pieces successively and make automatic performance of the plural music pieces successively in accordance with this preset order of performance. There is an automatic performance device of this type in which the order of performance of the plural music pieces can be determined as desired on the basis of, for example, operation by the user.

In this type of prior art device, however, shifting to performance of a next music piece can be made only at a time point at which performance of one music piece has been completed and it is not possible to stop performance of a music piece which is being played midway to shift to performance of a next music piece. Hence, it is not possible in this type of device to promptly recognize the actually set order of performance by, for example, listening to only the beginning portions of individual music pieces to make a quick shift from a music piece to a next one. It is also not possible in this type of device to perform a certain music piece repeatedly and then stop performance of the music piece midway to shift to a next music piece. Thus, in this type of prior art automatic performance device, the degree of freedom or flexibility in the automatic performance is extremely restricted.

SUMMARY OF THE INVENTION

It is, therefore, an object of the invention to provide an automatic performance device in which, when plural music pieces are successively performed in a desired order, performance of a music piece which is being played can be stopped at a suitable position to shift to performance of a next music piece.

An automatic performance device achieving the above described object of the invention comprises memory means for storing automatic performance data for plural music pieces, order setting means for setting an order of automatically performing the music pieces, performance means for reading the automatic performance data from said memory means in accordance with the order of performance set by said order setting means to perform the music pieces successively, instruction means for instructing shifting to performance of a next music piece during performance of a certain music piece by said performance means, and control means responsive to the instruction by said instruction means for controlling said performance means so as to shift to performance of the next music piece specified in accordance with said order of performance.

The performance means reads out the automatic performance data of plural music pieces in accordance with the order of performance set by the order setting means and peforms the music pieces successively. When shifting to a next music piece is instructed by the instruction means during playing of a certain music piece, the control means performs the control, in response to the instruction, so as to stop the music piece which is being played, and performs shifting to the next music piece according to the order of performance. The music which is being played is preferably stopped at a predetermined position in the performance pattern. This position may be, for example, a bar which occurs for the first time after the instruction by the instruction means has been made or a point at which a predetermined performance phrase ends.

In an embodiment of the invention, the order setting means may be one in which a predetermined order of performance is preset. In another embodiment of the invention, the order setting means may be one in which the order of performance is set at random. In the latter case, a next music piece is determined at random in accordance with the instruction issued by the instruction means.

A preferred embodiment of the invention will be described below with reference to the accompanying drawings.

BRIEF DESCRIPTION OF THE DRAWINGS

In the accompanying drawings.

DESCRIPTION OF PREFERRED EMBODIMENTS

Figure 1:
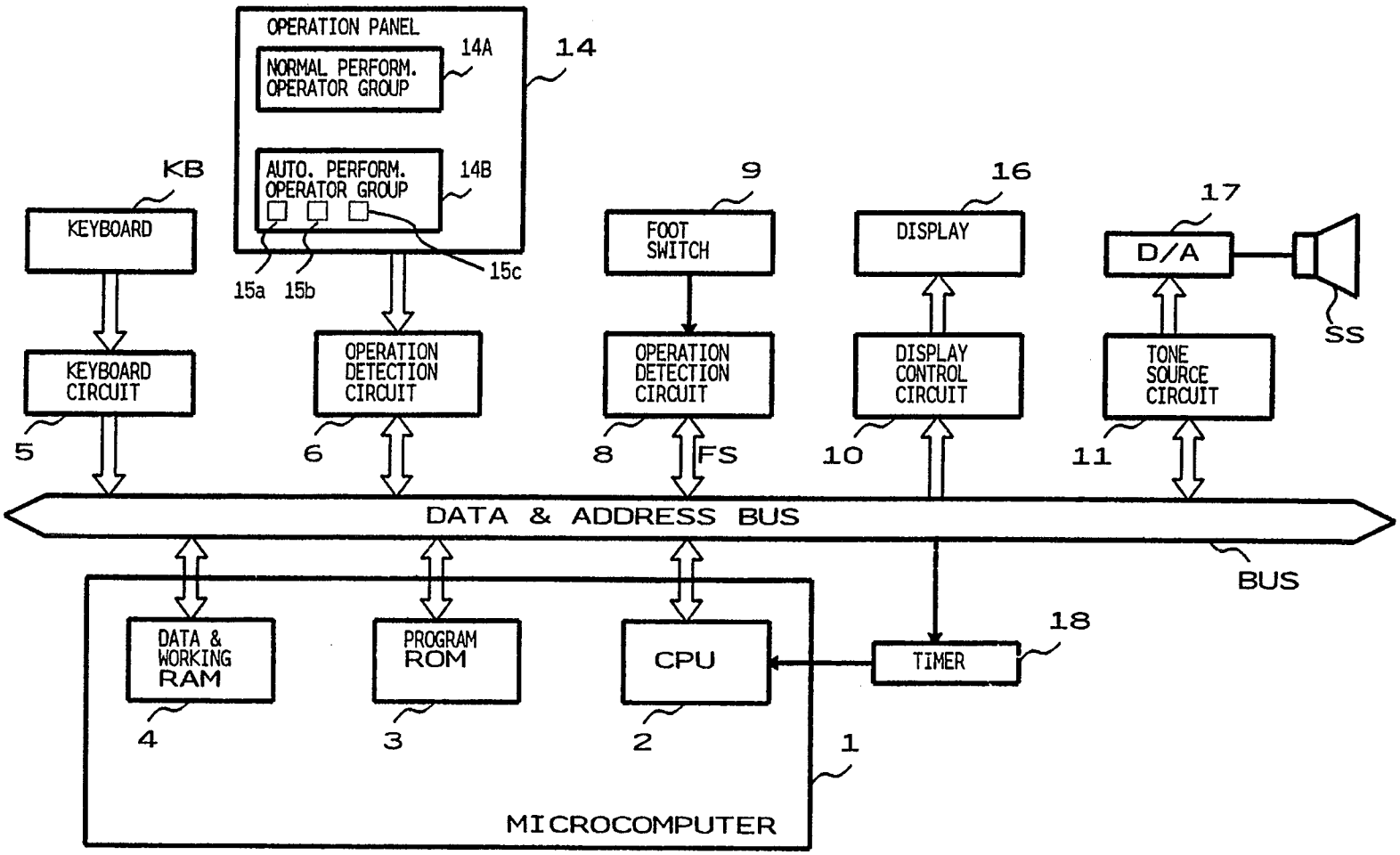
FIG. 1 is a block diagram showing a hardware structure of an embodiment of an electronic musical instrument incorporating the automatic performance device according to the invention.

Referring first to FIG. 1, the electronic musical instrument of this embodiment has a rhythm machine function performing an automatic performance of rhythm and performs Various processings under the control of a microcomputer 1 including a CPU 2, a program ROM 3 and a data and working RAM 4. It is known in the art that a rhythm music made by combining plural rhythm patterns in a desired manner is called a "song". The term "song" herein is used to mean such rhythm music.

As will be described more fully later with reference to FIG. 2, automatic performance data for automatically performing plural songs is stored in a predetermined storage area in the data and working RAM 4. In the electronic musical instrument of this embodiment, these songs are automatically and successively played by reading out and reproducing this automatic performance data successively.

A foot switch 9 is a switch for remote controlling which is operated by the foot of a performer. By operating this foot switch 9, a song which is being played is compulsorily stopped, through a processing to be described later, and shifting to performance of a next song is made possible.

To the microcomputer 1 are connected, through a data and address bus BUS, a keyboard circuit 5, a panel operation detection circuit 6, a foot switch operation detection circuit 8, a display control circuit 10 and a tone source circuit 11.

The keyboard circuit is provided in correspondence to a keyboard KB having keys for designating tone pitches of tones to be generated and detects depression and release of each of the keys of the keyboard KB provide key depression information and key release information.

The panel operation detection circuit 6 is provided in correspondence to operators such as switches and knobs provided in an operation panel 14 and produces operation data corresponding to states of operation of the respective operators. The operators in the operation panel 14 include a normal performance operator group 14A for controlling tone color, tone volume and an effect of a tone to be generated, and an automatic performance operator group 14B for performing an automatic performance. The automatic performance operator group 14B includes a start-stop switch 15*a* for starting and stopping the automatic performance, an operator 15*b* for variably setting an order of playing plural songs to be played successively and an operator 15*c* for designating whether each song should be played repeatedly or not.

The foot switch operation detection circuit 8 detects an operation on the foot switch 9 and thereupon produces a foot switch event signal FS.

The display control circuit 10 controls a display 16 which displays information including states of various operators in the operation panel 14.

The tone source circuit 11 includes a tone source circuit for scale tones and a tone source circuit for rhythm tones, and can generate tone signals of scale tones and rhythm tones in each of plural tone generation channels on the basis of various data including key depression information, key release information, automatic performance data, operation data and a foot switch event signal FS which are applied through the data and address bus BUS. The tone signals generated by the tone source circuit 11 are digital-to-analog converted by a digital-to-analog converter 17, and thereafter are acoustically propagated through a sound system SS.

Figure 6:
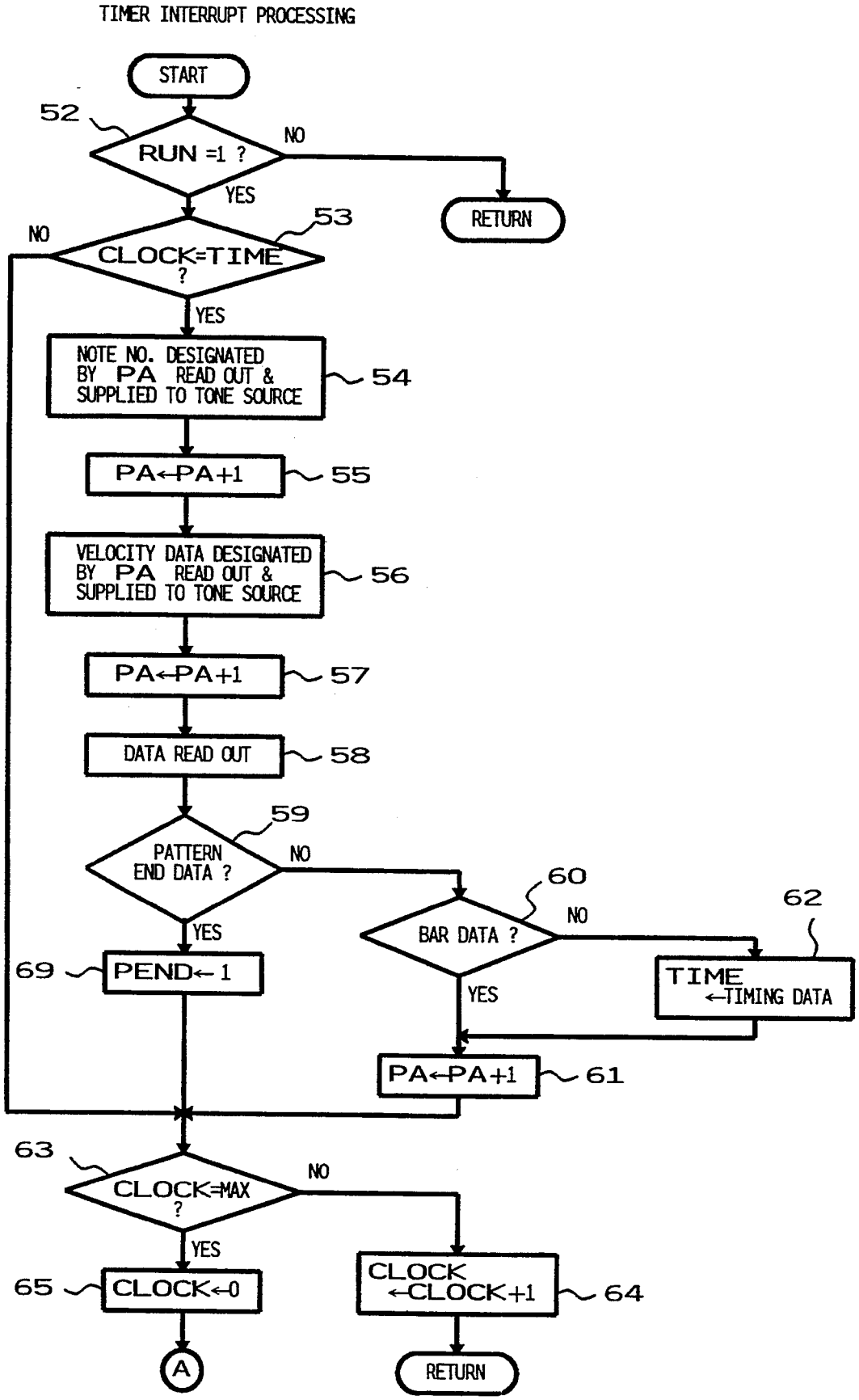
FIG. 6 is a flow chart showing a part of an example of a timer interrupt processing executed by the microcomputer in FIG. 1.
Figure 7:
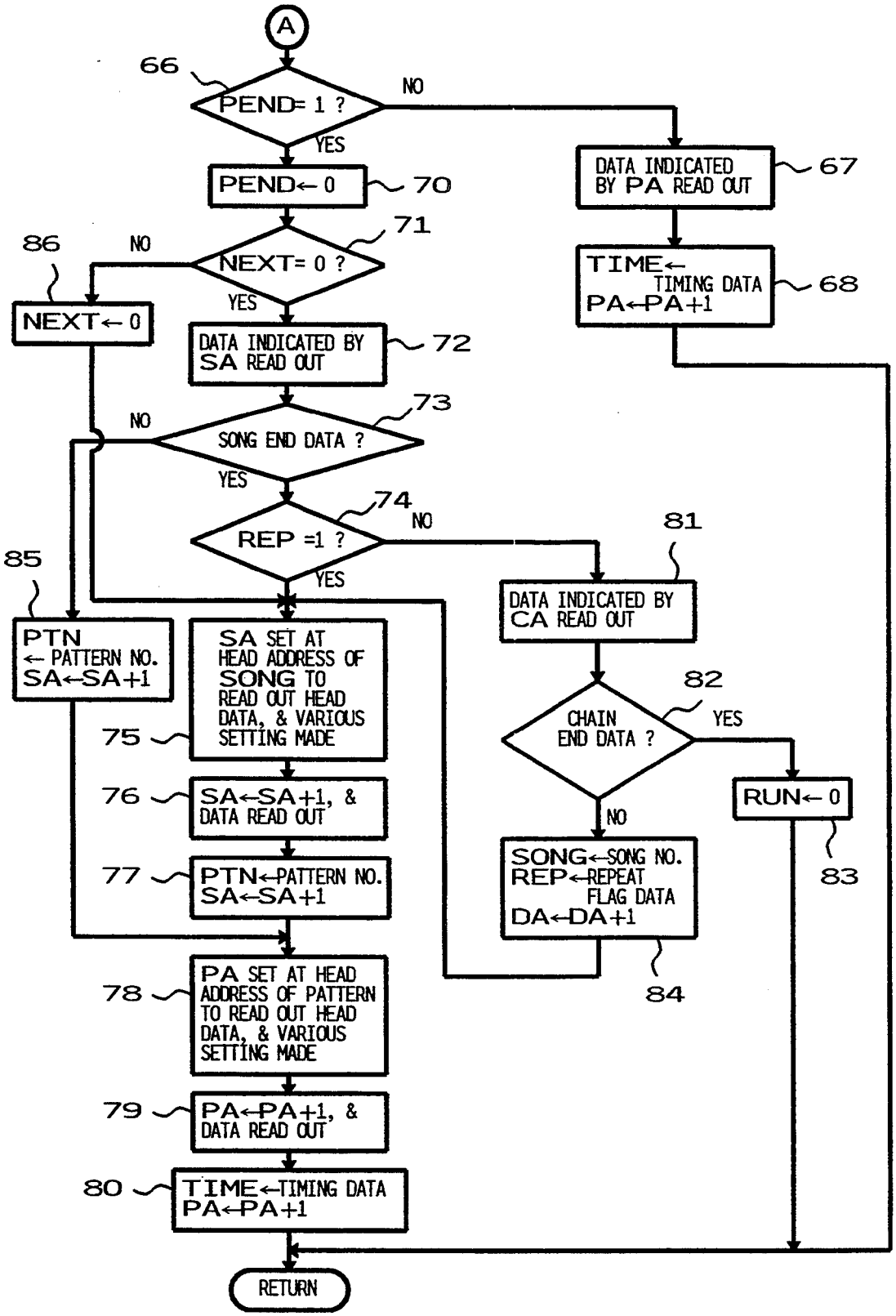
FIG. 7 is a flow chart showing the rest of the example of the timer interrupt processing.

A timer 18 generates a predetermined tempo clock signal in accordance with a performance tempo which is variably set by an unillustrated operator in the operation panel 14, and supplies this tempo clock signal as a timer interrupt signal to the CPU 2. Responsive this timer interrupt signal, the CPU 2 performs a timer interrupt processing, an example of which is shown in FIGS. 6 and 7. In this embodiment, the timer interrupt signal is generated at a timing which is obtained by dividing a crochet by 24. In the case of four—four time, for example, 96 timer interrupt signals (96 tempo clocks) correspond to the length of one measure.

Figure 2A:
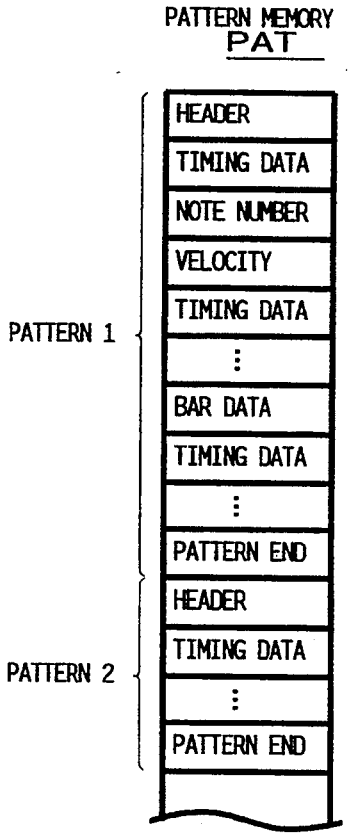
FIGS. 2A–2C are diagrams showing examples of memory formats of memories storing automatic performance data used in this embodiment.
Figure 2B:
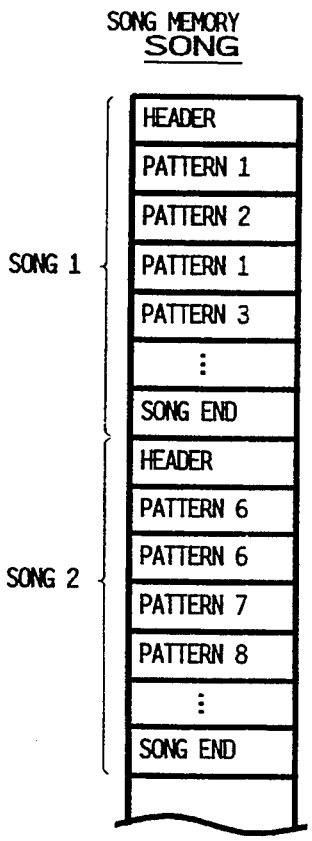
Figure 2C:
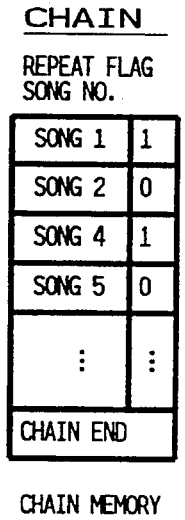

In the data and working RAM 4, there are provided as described before, memories prestoring automatic performance data for making the automatic performance of plural songs. FIGS. 2A–2C show an example of memory formats of these memories. A pattern memory PAT (FIG. 2A) stores different patterns (i.e., rhythm patterns). A song memory SONG (FIG. 2B) stores plural songs, each of which is a combination of some of the rhythm patterns. A chain memory CHAIN (FIG. 2C) stores an order of playing these songs successively.

More specifically, in the illustrated example, the pattern memory PAT stores, in the order of reading out, header data representing data including the number of beats for one measure concerning each pattern, timing data representing a tone generation timing in the particular measure, event data including a note number corresponding to the type of the tone (e.g., drum tone, cymbal tone etc.) and velocity data representing strength of the tone, and pattern end data representing the end of the pattern. In this example, the timing data indicates time length from the beginning of the measure to the tone generation timing in the reference time unit which is derived by dividing a crochet by 24. In a case where, as in pattern 1 in the illustrated example, the pattern consists of plural measures, bar data is stored after the last data of one measure. This indicates that no more events exist in this measure but a bar comes next. Following this bar data, the above described timing data and subsequent data are similarly stored for each tone to be generated in a next measure. A pattern address pointer successively designates addresses of data from the header data to the pattern end data of each pattern and the data of the pattern are successively read out by such address designation.

The song memory SONG stores each song which consists, in the order of reading out, of header data representing data including performance tempo of the song and tone color of a tone to be generated, pattern numbers of the patterns constituting the song (pattern 1, pattern 2 etc.) and song end data representing the end of the song. A song address pointer SA successively designates addresses of data from the header data to the song end data of each song.

The chain memory CHAIN stores, in the order of reading out, song numbers (song 1, song 2 . . . . ) representing the songs to be played successively and chain end data representing the end of the chain memory CHAIN. The song numbers are stored in the order of performance of the songs. As described above, the order of performance of the songs can be variably set in a desired order by operating the operator 15*a* of the operation panel 14. A chain address pointer CA successively designates addresses of the data in the chain memory CHAIN.

Repeat flag data corresponds to the song numbers stored in the chain memory CHAIN. As the repeat flag data, "0" is stored for a case where a corresponding song is to be played only once without repeating and "1" is stored for a case where a corresponding song is to be played several times repeatedly. As described above, whether each song is to be repeated or not is designated by operating the operator 15*c* of the operation panel 14.

The number of times a song is repeated is set by an unillustrated operator of the operation panel 14.

Figure 3:
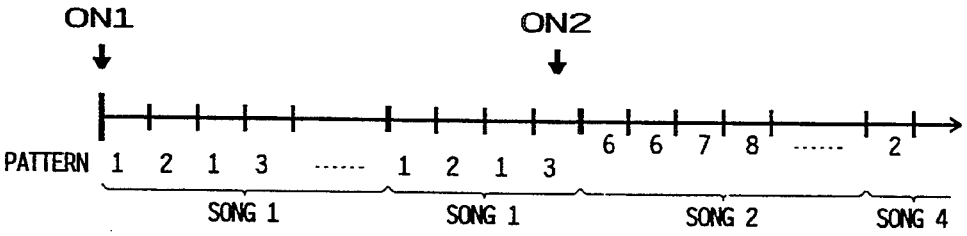
FIG. 3 is a diagram for schematically explaining the operation of the embodiment.

FIG. 3 schematically shows the operation performed in accordance with the automtic performance data shown in FIG. 2. Upon turning on of the foot switch 9 initially as shown by ON1 in FIG. 3, the song number 1 stored initially in the chain memory CHAIN is read out. In response to the reading of the song number 1, the header data stored at the first address of the song 1 in the song memory SONG is read out and the first pattern number 1 stored at the address immediately, thereafter is read out. Then, in response to the reading of the pattern number 1, data from the header data to the pattern end data of the pat tern 1 stored in the pattern memory PAT is read out whereby performance of the pattern 1 is provide. Upon completion of the performance of the pattern 1, performances from the pattern 2 to the last pattern constituting the song 1 are made by similar processing. In this manner, a single performance of the song 1 is completed. Since, in this case, repeat flag data for the song 1 is "1", the song 1 is repeatedly played a predetermined number of times unless the foot switch 9 is turned on again. Thereafter, the song 2, song 3, song 4, song 5, . . . . are successively played in the same manner as described above in accordance with repeat flag data for each song in the order of reading out in the chain memory CHAIN. Since, in this case, repeat flag data of the song 2 is "0", the song 2 is played only once and then shifting to the next song 4 is automatically made.

When, however, the foot switch 9 is turned on again as shown by ON2 in FIG. 3 during performance of the song 1 for the second time, the performance of the song 1 compulsorily stopped and shifting to the next song 4 is made at a time point when the pattern 3 which is the pattern currently being played has ended. Thereafter, shifting from the song 2 to the song 4 is automatically made. When the foot switch 9 is turned on again as shown by ON3 in the figure during the first performance of the song 4, the performance of the song 4 is compulsorily stopped, and shifting to the next song 5 is made at a time point when the performance of the pattern 2 which is currently-being played has ended.

As described above, according to this embodiment, by turning on of the foot switch 9 after the automatic performance of the song is started in response to a first turning on of the foot switch 9, shifting to a next song is made at a time point when the performance of a pattern which is currently being played has ended. The automatic performance which has started as described above ends when the performance of the last song has ended, after the performance has progressed in accordance with the order of reading in the chain memory CHAIN and also when the foot switch 9 is turned on during the performance of the last song.

In the microcomputer 1 in this embodiment, there are provided the following registers used in various processings to be described later:

RUN: a run flag which stores "1" when the automatic performance has started, i.e., during running of the automatic performance and "0" when the automatic performance is not made.

SONG: a song number register storing a song number of a song to be played.

PTN: a pattern number register storing a pattern number of a pattern to be played.

REP: a repeat flag register storing repeat flag data corresponding to each song number stored in the chain memory CHAIN.

TIME: a timing register storing a tone generation timing in a measure.

NEXT: a shifting flag storing "1" when shifting to a next song is to be made upon completion of performance of a pattern of a song while the foot switch is on and otherwise storing "0".

CLOCK: a clock register storing a position of progress in a measure at the above described reference time unit. In this embodiment, This clock register CLOCK uses a value ranging from 0 to 95 in the case of four—four time, for example, and a value ranging from 0 to 71 in the case of three-four time.

PEND: a pattern end flag storing "1" when a pattern which is currently being played is at the end and otherwise storing "0".

MAX: a maximum clock value register storing a maximum clock value in one measure at the above described reference time unit. In this embodiment, the maximum clock value is 95 in the case of four—four time and 71 in the case of three-four time.

An example of various processings executed by the microcomputer 1 will now be described with reference to the flow charts of FIGS. 4 to 7.

Figure 4:
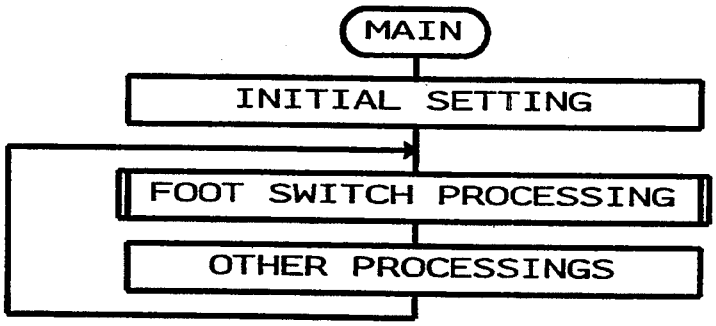
FIG. 4 is a flow chart showing an example of a main routine executed by a microcomputer in FIG. 1.
Figure 5:
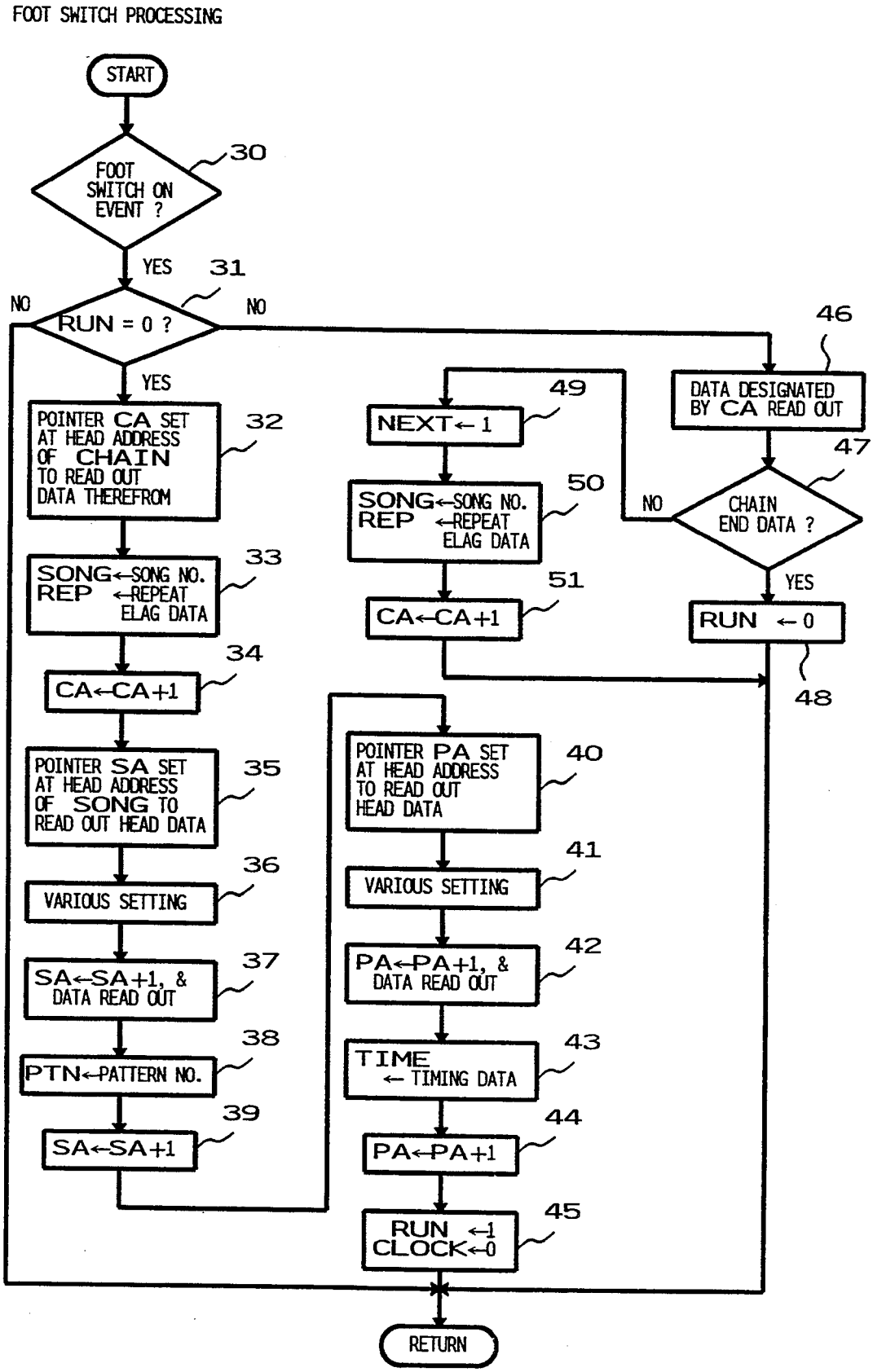
FIG. 5 is a flow chart showing an example of a foot switch processing executed by the microcomputer in FIG. 1.

FIG. 4 shows an example of the main routine. In the main routine, a predetermined initial setting is made and then a foot switch processing as shown in FIG. 5 by way of example and to be described more fully later and other processings are repeatedly executed. The other processings include processings corresponding detection of depression and release of a key, programming processings for writing the above described respective automatic performance data in the chain memory CHAIN, song memory SONG and pattern memory PAT and a panel processing for detecting states of operation of the operators of the operation panel 6 and performing various processings on the basis of detection of the states of operation of the operators.

The foot switch processing shown in FIG. 5 is a processing in which the automatic performance is started when the foot switch is turned on in a state where the automatic performance is not made and, when the foot switch 9 is turned on during the automatic performance, a song which is being played is stopped and shifting to a next song is made or the automatic performance is stopped. In this foot switch processing, whether there is a foot switch on event or not is first examined (step 30). When there is no foot switch on event, the foot switch processing is finished without performing other processings. When there is a foot switch on event, whether or not the run flag RUN is "0" is examined (step 31).

Processing for starting the automatic performance

When the foot switch 9 is turned on as shown by ON1 in FIG. 3 before the automatic performance is started, the result of step 31 becomes YES and the following processing for starting the automatic performance is executed. First, the chain address pointer CA is set at the head address of the chain memory CHAIN and the first song number (song 1 in the example of FIG. 2) stored at the head address and the value of the repeat flag data corresponding to the song number (1 in the example of FIG. 2) are read out (step 32). The read out song number and repeat flag data value are stored respectively at the song number register SONG and the repeat flag REP (step 33). Then, the chain address pointer CA is advanced by 1 in preparation for reading of the next data in the chain memory CHAIN (step 34).

Then, the song address pointer SA is set at the head address of the song of the song number read out in step 32, and head data stored at the head address is read out (step 35). Various setting including settings of tempo and tone color for the song are made (step 36). Then, the song address pointer SA is advanced by 1 and the first pattern number stored at an address next to the head address is read out (step 37). Further, the read out pattern number is stored in the pattern number register PTN (step 38) and the song address pointer SA is advanced by 1 in preparation for reading of data at a next address in the song memory SONG (step 39).

Then, the pattern address pointer PA is set at the head address of the pattern of the pattern number read out in step 36 among the plural patterns in the pattern memory PAT, and head data stored at this head address is read out (step 40). Various settings including setting of the beat number for the pattern are made in accordance with the head data (step 41). The pattern address pointer PA is thereafter advanced by 1 and timing data stored at an address next to the head address is read out (step 42). The read out timing data is stored in the timing data register TIME (step 43) and the pattern address pointer PA is advanced by 1 (step 44). In this manner, preparation for reading out event data of the pattern is finished. For indicating that the automatic performance is now in progress, the run flag RUN is set to "1" and the clock register CLOCK indicating the position of progress in the measure is reset to "0" and, thereafter, this foot switch processing is finished step 45). Actual reading of the event data is made in a timer interrupt processing of FIGS. 6 and 7 to be described later.

Processing after starting of the automatic performance

Stopping of automatic performance

On the other hand, when the foot switch 9 is turned on during running of the automatic performance, the result of step 31 becomes NO and data in the chain memory CHAIN at the address designated by the chain address pointer CA is read out (step 46). Whether or not the read out data is the chain end data is examined (step 47). When the result is YES, i.e., it is the chain end data, the run flag RUN is turned to "0" for stopping the automatic performance (step 48) and, thereafter, the foot switch processing is finished.

Processing for performing shifting of the song

When the data read out in step 46 is not the chain end data but a next song number, the song which is currently played is compulsorily stopped and the shifting flag NEXT is turned to "1" for performing shifting to the song of the read out next song number (step 49). The song number and repeat flag data value corresponding to the song number are respectively stored in the song number register SONG and the repeat flag REP (step 50). The chain address pointer CA is advanced by 1 (step 51 ). Thereafter, the foot switch processing is finished.

Each time a timer interrupt signal is supplied from the timer 18 to the CPU 2 at the above described timing which is obtained by dividing a crochet by 24 in the process of performing the main routine of FIG. 4, the timer interrupt processing shown in FIGS. 6 and 7 is performed. In this timer interrupt processing, whether or not the run flag RUN is "1" is first examined (step 52). When the result of step 52 is NO, it indicates that the automatic performance has not started yet and, therefore, the routine returns to the main routine without performing other processings.

Reading of event data and tone generation

When the automatic performance is running, the result of step 52 becomes YES and, in this case, whether or not the value of the clock register CLOCK coincides with the value of the timing register TIME, i.e., whether or not the current position of progress in the measure coincides with the tone generation timing data indicated by timing data of the pattern which is currently being played, is examined in a next step 53.

When the result of step 53 is YES, for generation of a tone, a note number which is data of an address designated by the pattern address pointer PA in the pattern memory PA is read out, and the read out note number is supplied to the tone source circuit 11 in step 54. Then, the pattern address pointer PA is advanced by 1 (step 55) and velocity data which is the next data is read out and the read out velocity data is supplied to the tone source circuit 11 (step 56). The tone source circuit 11 generates a tone signal on the basis of the note number and the velocity data and supplies this tone signal to the sound system SS through the digital-to-analog converter 17. In this manner, a tone concerning the event data is acoustically sounded.

Then, the pattern address pointer PA is advanced by 1 (step 57) and the next data (i.e., any of timing data, bar data and pattern end data) is read out (step 58). Whether or not the data read out in step 58 is the pattern end data is examined (step 59).

Processing before the pattern end

When the read out data is not pattern end data, whether or not the read out data is bar data is examined (step 60). When the result is YES, i.e., the read out data is bar data, the pattern address pointer PA is advanced by 1 in preparation for reading of the next data (step 61). When the result of step 60 is NO, it indicates that the read out data is timing data and, in this case, the value of the timing data is stored in the timing register TIME (step 62) and then the routine proceeds to step 61.

Then, whether or not the value of the clock register CLOCK coincides with the value of the maximum clock value register MAX, i.e. , whether or not the current position of progress in the measure has reached the maximum clock value with respect to the measure, is examined (step 63). In this manner, the processing of step 63 is made also when the data read out in step 58 is bar data, because bar data is data which merely indicates that a bar will occur next and is located before an actual bar and, accordingly, it is necessary to wait until the position of progress after reading out of the bar data reaches the maximum clock value. Therefore, as long the as result of step 63 is NO, the value of the clock register CLOCK is incremented by 1 (step 64) and the routine returns to the main routine. By the processing of step 64, the value of the clock register CLOCK, i.e., the current position of progress in the measure, is incremented by 1 for each timer interrupt processing. In this manner, when the result of step 63 has become YES, i.e., when the current position of progress in the measure has reached the maximum clock value with respect to this measure, the clock register CLOCK is reset to "0" (step 65) and the routine proceeds to step 66. When the value of the clock register CLOCK does not coincide with the value of the timing register TIME in step 53, the routine proceeds directly from step 53 to step 63 and step 64.

In step 66, whether or not the pattern end flag PEND is "1" is examined. In a case where the pattern which is currently being played includes plural measures, the pattern end flag PEND is initially not "1" and, therefore, the result of step 66 becomes "NO". In this case, data indicated by the pattern address pointer PA, i.e., timing data for a first event in the next measure, is read out (step 67). The value of the read out timing data is stored in the timing register TIME and the pattern address pointer PA is advanced by 1 (step 68), and then the routine returns to the main routine.

Processing at the pattern end

As the performance of patterns proceeds and the result of step 59 becomes YES, i.e., when the data read out in step 58 has become the pattern end data, the pattern end flag PEND is turned to "1" (step 69) and, thereafter, the processings from step 63 to step 66 are executed. In this case, the result of step 66 becomes YES and, in step 70, the patten end flag PEND is turned to "0". Then, whether or not the shifting flag NEXT is "0" is examined (step 71).

When the result of step 71 is YES, i.e., when the foot switch 9 is not on and shifting to a next song should not be made, data indicated by the song address pointer SA is read out (step 72) and whether or not the read out data is the song end data is examined (step 73). When the read out data is the song end data, whether or not the repeat flag REP is "1" is examined (step 74).

Processing for making repeated performance

When step 74 is YES, the song address pointer SA is set at the head address of the song to repeat the performance of the song which has been so far played and the head data is read out and various settings are made in accordance with the head data (step 75). Then, the song address pointer SA is advanced by 1 and the next data, i.e., the first pattern number of the song, is read out (step 76). The read out pattern number is stored in the pattern number register PTN and the song address pointer SA is advanced by 1 (step 77). Further, the pattern address pointer PA is set at the head address of the pattern of the read out pattern number to read out the header data, and various settings are made in accordance with the read out header data (step 78). The pattern address pointer PA is advanced by 1 and the next data, i.e., timing data of the pattern, is read out (step 79). Then, the read out timing data is stored in the timing register TIME and the pattern address pointer PA is advanced by 1 (step 80). The routine thereafter returns to the main routine.

When the data read out in step 72 is the song end data and the song which has been so far played is not set as a song to be played again, the result of step 74 becomes NO and, in this case, data indicated by the chain address pointer CA is read out (step 81). In a next step 82, whether or not the read out data is chain end data is examined. When the read out data is the chain end data, the run flag RUN is turned to "0" for stopping the automatic performance (step 83) and the routine returns to the main routine.

Automatic shifting of a song

In a case where the automatic performance is automatically shifted to a next song in accordance with an order of performance set by the player, the result of step 82 becomes NO, i.e., not the chain end data but a next song number. Therefore, the song of the song number is stored in the song number register SONG for playing the song and the value of the repeat flag data for the song number is stored in the repeat flag REP and, further, the chain address pointer CA is advanced by 1 (step 84). Then, for playing this next song, the processings from step 75 to step 80 are executed.

Shifting of the pattern

When the result of step 73 is NO, i.e., when the data read out in step 72 is not the song end data but a next pattern number of the song which has been so far played, the pattern number is stored in the pattern number register PTN for playing the pattern of this pattern number, and the song address pointer SA is advanced by 1 step 85). Thereafter, the processings from step 78 to step 80 are executed.

Compulsory stopping of a song and shifting to a next song

When the foot switch 9 is turned on for compulsorily stopping the song which is currently being played and shifting to a next song, the shifting flag NEXT is "1" and, therefore, the result of step 71 becomes NO. In this case, the shifting flag NEXT is turned to "0" (step 86) and then, for playing a next song, the processings from step 75 to step 80 are executed. In this case, by the processings of step 56 to step 65, shifting to the next song is made at a time point when the performance of the pattern of the song which is currrently being played is completed. Accordingly, a preceding song is stopped at a proper stop point and a natural shifting to a next song is accomplished.

In the above described embodiment, shifting to a next song is made at a time point when the pattern of a song which is being played when the foot switch 9 is turned on has ended. Alternatively, shifting to a next song may be made, for example, when a measure of a song which is being played when the foot switch 9 is turned on or other predetermined suitable section (phrase) has ended.

The invention is applicable not only to a case where, as described above, a music piece consisting of a combination of plural patterns is automatically performed, but also to a case where a music piece consisting of normal continuous automatic performance data is performed.

The foot switch may be substituted by other suitable shifting designation means.

The invention is applicable not only to an automatic performance device in which the order of performance of plural music pieces is previously determined, but also to an automatic performance device in which the order of automatic performance is randomly set when designation by the shifting designation means is made, to determine a music piece to be played next.

In the above described embodiment, description has been made of the automatic rhythm performance. The invention however is applicable not only to the automatic rhythm performance but to other automatic accompaniment devices and other automatic performance devices. The invention is applicable also to an automatic performance device module having no tone generation function or an automatic performance software program.

As described in the foregoing, according to the invention, means for designating shifting to a next music piece during performance of a certain music piece is provided and shifting to a next music piece is made in accordance with the shifting designation. By this structure, performance of a music piece can be stopped at a proper point of the music piece to shift to a next music piece.

We claim:

1. An automatic performance device comprising:
memory means for storing automatic performance data for a plurality of different music pieces;
order setting means for setting an order of automatically performing the music pieces;
performance means for reading the automatic performance data from said memory means in accordance with the order of performance set by said order setting means to perform the music pieces successively;
instruction means for instructing shifting to performance of a next music piece during performance of a certain music piece by said performance means; and
control means responsive to the instruction by said instruction means for controlling said performance means so as to shift to performance of the next music piece specified in accordance with said order of performance.

2. An automatic performance device as defined in claim 1, wherein said order setting means comprises order memory means for storing information representing the order of performance of the plurality of different music pieces and order readout means for reading out the information representing the order of performance from said order memory means.

3. An automatic performance device as defined in claim 2, wherein said order memory means further stores repeat information instructing whether or not repeated performance should be made of a music piece to be performed.

4. An automatic performance device as defined in claim 1, wherein the automatic performance data for one music piece stored in said memory means includes plural performance pattern data and song data programming the order of performance of the respective performance pattern data.

5. An automatic performance device as defined in claim 4, wherein said control means performs a control so as to stop performance of the music piece at an end position of the pattern data which is being played to shift to performance of the next music piece.

6. An automatic performance device as defined in claim 1, wherein said control means performs a control so as to stop performance of the music piece at a predetermined position of the music which is being played to shift to performance of the next music piece.

7. An automatic performance device as defined in claim 6, wherein said predetermined position is a position at which a measure of the music piece which is being played changes.

8. An automatic performance device as defined in claim 1, where in said order setting means sets the order of performance of the plural music pieces at random.

9. An automatic performance device comprising:
memory means for storing automatic performance data for a plurality of different music pieces;
performance means for reading the automatic performance data of a desired music piece from said memory means and automatically performing the music piece on the basis of the read out automatic performance data;
instruction means for instructing a change of a music piece to be performed during performance of a certain music piece of the plurality of different music pieces; and
control means responsive to the instruction by said instruction means for controlling said performance means so as to shift to performance of another music piece at a predetermined timing after said instruction has been made.

10. An automatic performance device as defined in claim 9, further comprising order memory means for storing information representing the order of performance of the plural music pieces and order readout means for reading out the information representing the order of performance from said order memory means.

11. An automatic performance device as defined in claim 10, wherein said order memory means further stores repeat information instructing whether or not repeated performance should be made of a music piece to be performed.

12. An automatic performance device as defined in claim 9, wherein the automatic performance data for one music piece stored in said memory means includes plural performance pattern data and song data programming the order of performance of the respective performance pattern data.

13. An automatic performance device as defined in claim 12, wherein said control means performs a control so as to stop performance of the music piece at an end position of the pattern data which is being played to shift to performance of the next music piece.

14. An automatic performance device as defined in claim 9, wherein said control means performs a control so as to shift to performance of the next music piece at a timing at which a measure changes for the first time after said instruction has been made.

* * * * *